United States Patent [19]

Kessler et al.

[11] 4,337,903

[45] Jul. 6, 1982

[54] METHOD OF AND A DEVICE FOR CONTROLLING THE EXCHANGE OF ROLLS OF A WEB-LIKE MATERIAL

[75] Inventors: Peter Kessler, Plauen; Joachim Kaiser, Plauen; Wolfgang Keil, Plauen; Hans-Günter Despang, Dresden; Jürgen Haufe, Koenigsbrueck; Matthias Kieser, Dresden, all of German Democratic Rep.

[73] Assignee: Veb Kombinat Polygraph "Werner Lamberz" Leipzig, Leipzig, German Democratic Rep.

[21] Appl. No.: 175,195

[22] Filed: Jul. 31, 1980

[30] Foreign Application Priority Data

Aug. 16, 1979 [DD] German Democratic Rep. ... 215006

[51] Int. Cl.[3] ..... B65H 19/20; B65H 19/12

[52] U.S. Cl. ..... 242/56 A; 242/58.2

[58] Field of Search ..... 242/58.1, 58.2, 58.3, 242/58.4, 58.5, 56 R, 56 A; 156/502, 504, 505

[56] References Cited

U.S. PATENT DOCUMENTS

| | | | |
|---|---|---|---|
| 2,939,646 | 6/1960 | Stone | 242/58.2 |
| 4,038,127 | 7/1977 | Bullock | 242/56 A |
| 4,077,580 | 3/1978 | Lang | 242/58.3 |
| 4,208,019 | 6/1980 | Dusenbery | 242/56 A |
| 4,278,213 | 7/1981 | Rubruck | 242/75.1 |

*Primary Examiner*—Edward J. McCarthy
*Attorney, Agent, or Firm*—Michael J. Striker

[57] ABSTRACT

The method of and device for controlling the roll exchanging operation in an unrolling device includes the provision of a set of control numbers computed from the counted number of revolutions of the old roll and from the length of the withdrawn web prior to the initiation of the roll exchanging operation; the control numbers are computed from two intervals of the measured web length, from corresponding intervals of the counted number of revolutions, from the thickness of the web, from the feeding speed of the web, from the time constents of the control elements of the roll exchanging device, from the length of the adhesive leading edge of the new roll, from the desired length of the residual trailing end portion of the old web and from the diameter of the supporting central reel; computed control numbers are stored and compared in a comparator with the actual number of revolutions of the old roll whereby the coincidence of the actual number with the stored number generates in a control unit a control signal which is fed to an assigned control element for the exchange.

8 Claims, 2 Drawing Figures

METHOD OF AND A DEVICE FOR CONTROLLING THE EXCHANGE OF ROLLS OF A WEB-LIKE MATERIAL

BACKGROUND OF THE INVENTION

The present invention relates in general to unrolling devices for rolls of a web-like material fed to high-speed processing machines, such as for example paper rolls for web fed rotary printing machines; in particularly, the invention relates to a method of and a device for the exchange of the rolls of the web-like material during the operation of the unrolling device.

From the German published patent application No. 2 619 236 a method for controlling the exchange of web rolls in the course of their unrolling process is devised according to which the swinging of the roll supporting reel into an adhering position relative to the processed roll, the acceleration of the new roll and the adjustment of its circumferential speed to the discharging speed of the old web and the actuation of the adhering and severing devices takes place at definite continuously computed values of the diameter or of the circumferential speed of the old roll. The computation is based on a predetermined value for a desired final diameter of the residual part of the old roll, on a predetermined value for the desired length of the adhered web portions and on the predetermined or measured time constants of respective mechanical actuation members as well as on the actual value of the discharge speed and the rotary speed of the old roll.

This known method, however, has the disadvantage that the time necessary for measuring and computing the instantaneous values of the diameter or of the circumference of the web roll during its unwinding process produces delays which introduce inaccuracies into the controlling process. Moreover, the known method necessitates a preliminary computation of the final diameter of the residual old roll by taking into account the thickness of the processed web material provided when the residual material on the old reel is to be kept at minimum.

SUMMARY OF THE INVENTION

It is, therefore, a general object of the present invention to overcome the aforementioned disadvantages.

More particularly, it is an object of the invention to provide an improved method of and a device for the exchange of web rolls during their unwinding operation which enables a simpler and a more reliable operation.

An additional object of this invention is to provide such an improved method and device which results in savings of the web material remaining on the reel of the old roll.

A further object of the invention is to simplify control elements while increasing the accuracy of the control process.

An additional object of the invention is to provide a controlling method in which it is no longer necessary to determine in advance the thickness of the material in order to ensure that a minimum amount of the residual web is left on the old roll.

In keeping with these objects, and others which will become apparent hereafter, one feature of the invention resides, in a method of controlling the exchange of rolls of a web-like material having an adhesive leading end portion, in the steps of counting the number of revolutions of the old roll and measuring the corresponding web length unrolled from the old roll, computing from at least two intervals of the count of revolutions and corresponding web lengths the total number of revolutions required for unwinding the old roll, computing from the ascertained total number of revolutions and from preset parameters including the thickness of the web, the length of the adhesive end portion, the permissible length of the residual web remaining in the old roll, the diameter of the reel, a set of control numbers for initiating respective steps of the roll exchanging operation, comparing the successive control numbers with the actual number of revolutions of the old roll to start in response to the coincidence of the respective control numbers with the actual numbers the steps of swinging the new roll into its adhering position in proximity to the web of the old roll, then accelerating the new roll to a circumferential speed corresponding to the speed of movement of the web of the old roll and holding the latter speed constant, then pressing a web portion of the old roll against the adhesive end portion of the new roll, and then severing the remainder of the web of the old roll. The computation of the control numbers before the initiation of the actual roll exchanging steps is repeated after any change in the speed of movement of the old web.

The method of this invention enables an exact control of the exchange of the web rolls at instants corresponding to preliminarily computed instantaneous conditions of the old roll in the process. By virtue of the predetermined control numbers the instantaneous conditions of the old roll are ascertained without the introduction of any time delay in the exchange controlling steps. Furthermore, this method enables the determination of the minimum length of the residual web on the old roll which is still functionally safe for the exchange of the rolls by means of a control number which is computed in advance independently from the measurement of the thickness of the web during the roll exchanging steps. Accordingly, when exchanging the rolls of a web material having different thickness, no changes in the entry of the different thickness values is necessary in the controlling method of this invention in order to ensure the minimum web residual on the old roll. Furthermore, the computing device after completing the computation of the set of control numbers before the initiation of the actual roll exchanging process, can be employed during the time interval when the exchange takes place for other computations.

The roll exchange can be affected by means of simpler control devices inasmuch as it is sufficient to continuously count the revolutions of the old roll and compare the same to the previously computed set of fixed control numbers.

According to this invention, the revolutions of the old roll are converted into counting pulses from which the total number of revolutions is interpolated from comparing two separate intervals of the counting pulses to corresponding two lengths measurements of the unrolled web material of the old roll, counted from a starting layer of the roll up to the diameter of the supporting reel whereby the spacing of the two intervals, the diameter of the reel, the thickness of the web material as well as the amount of counting pulses for one revolution are taken into account.

In a further development of the method of this invention the speed of movement of the web of the old roll is computed by counting for a predetermined time interval pulses corresponding to a length of the old web and by ascertaining the length of travel of the web per one pulse; the thickness of the web material is computed from the number of pulses corresponding to unrolled lengths of the web measured during two separate intervals correlated with pulses corresponding to the revolutions of the old roll during the same intervals, from the spacing between the respective intervals, from the length of the web per one pulse and the number of pulses per one rotation of the old roll. In this manner, the average value of the thickness of the web material over a large number of windings of the roll can be determined with a high accuracy.

The method of this invention is with advantage performed on a device which includes a comparator circuit fed at one input thereof with pulses counting the revolutions performed by the old roll and a second input connected to a counting and storing unit in which the computed set of control numbers is stored. The output of the comparator are connected to a control circuit for actuating in the given order the individual control subunits of the unrolling device. The inputs of counting and storing units are connected to respective pulse generators for counting the rotation of the old roll and for measuring the length of the unrolled old web in relation to the counting pulses. The output of the counting and storing unit is also connected to the control unit to generate common pulses for initiating the individual controlling operation, that means for activating the motors for swinging the new roll into its adhering position, the motor for imparting an acceleration to the new roll, the motor for activating the brush and a solenoid for activating a severing tool in the adhesion device; the angular position of the new roll is further controlled by a signal generator cooperating via the counting and storing unit with the control unit to adjust a proper angular position of the leading adhesive end of the new roll with respect to the terminal web portion of the old roll.

The novel features which are considered as characteristic for the invention are set forth in particular in the appended claims. The invention itself, however, both as to its construction and its method of operation, together with additional objects and advantages thereof, will be best understood from the following description or specific embodiments when read in connection with the accompanying drawing.

DESCRIPTION OF THE PREFERRED EMBODIMENTS

Figure 1:
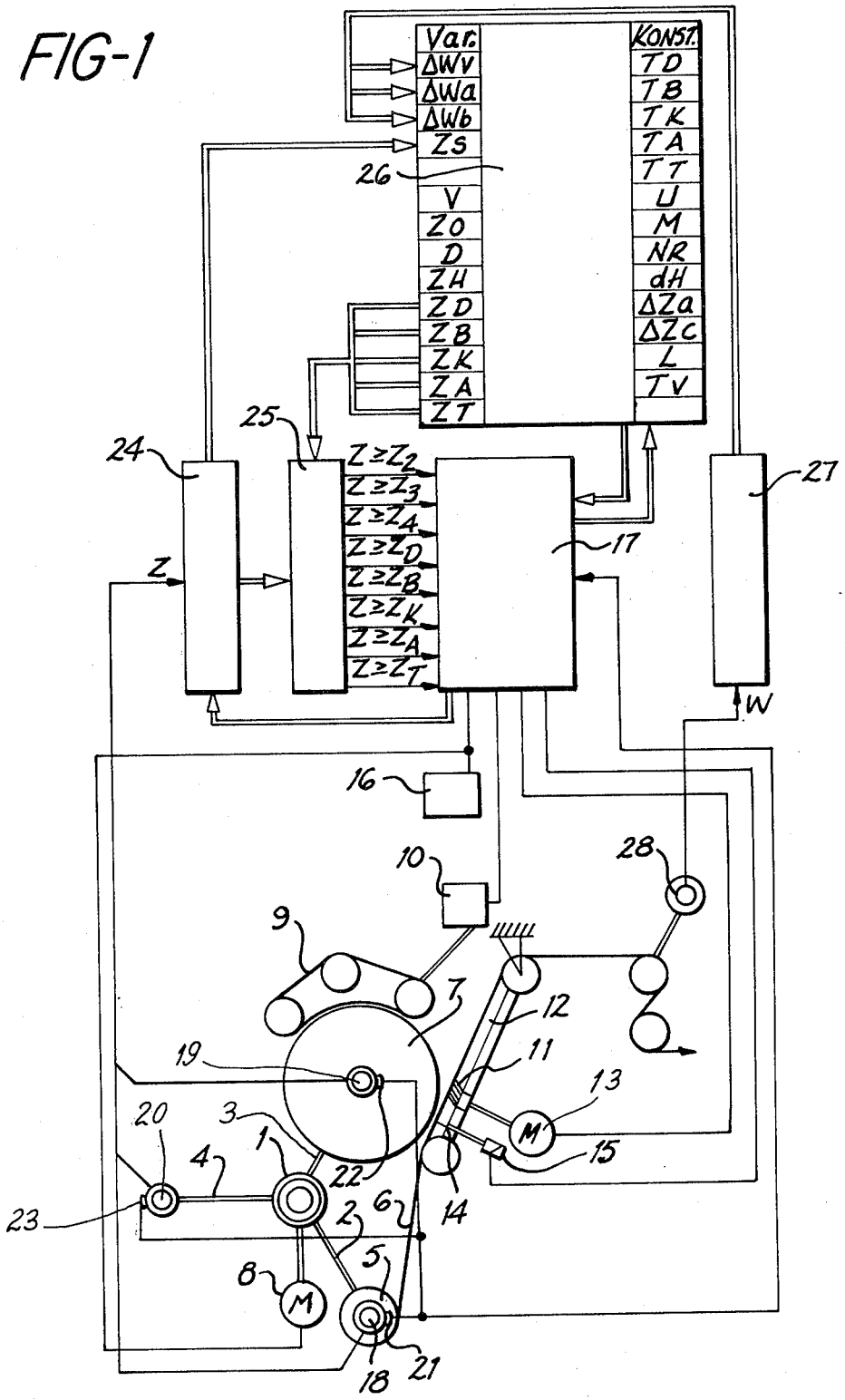
FIG. 1 shows schematically an unrolling device equipped with a device for controlling the exchange of web rolls.

The unrolling device depicted schematically in FIG. 1 includes a rotary reel support 1 including three pairs of arms 2, 3 and 4 spaced one from the other by 120° and each pair being provided with means for clamping a central sleeve of the roll to be processed. In the given example, arms 2 support an almost exhausted old roll 5 from which the web 6 of a material is being unrolled. A new roll 7 is clamped between the arm 3 and immediately before the termination of the web 6 of the roll 5, its leading end is to be fixed to the moving web 6. In FIG. 1, the rotary roll support 1 is shown in a position in which the new roll 7 is located in close proximity to the track of the web 6, that is in a position in which the adhering step takes place. As it will be explained in more detail below, only at the beginning of the roll exchanging operation, the driving motor 8 rotates the roll support 1 about 120° clockwise to place the new roll 7 into the depicted adhering position. The control device of this invention is provided with means which upon the start of this first exchange controlling step prevent the main drive of the web fed machine such as for example a rotary press from increasing its working speed. Subsequently, a driving belt 9 is brought in contact with the new roll 7 and adjusts its circumferential speed to the feeding speed of the web 6. For this purpose, the driving belt 9 is mechanically coupled to an acceleration drive 10. As soon as the speed synchronization is completed, a brush 11 mounted on a rocking arm 12 compresses the running old web 6 against the adhesive leading end portion of the new roll 7 whereupon a cutting blade 14 which is also mounted on the arm 12 severs the residual end portion of the old web 6. The brush 11 is actuated by a motor 13 and the cutter 14 is actuated by a solenoid 15.

In order to control the roll exchanging operation, the aforementioned motor 8 for the roll support, the accelerating drive 10, the brush actuating motor 13 and the cutter actuating solenoid 15 as well as the main drive 16 for the non-illustrated web processing machine are connected to respective outputs of a control circuit 17. The clamping reels at the free ends of respective arms 2, 3 and 4 of the roll support 1 are coupled to revolution counting pulse generators 18, 19 and 20 and to angular position indicating signal generators 21, 22 and 23. The generators 18, 19 and 20 generate pulses Z indicative of respective revolutions of the processed roll and these pulses Z are applied to a rotation counter 24 which is controlled by the control unit 17 for selecting the proper counting signal generator. One output of the counter 24 is connected to a parallel comparator 25 and another output is connected to a computing and storing unit 26. The other input of the parallel comparator 25 is connected to a computed data storing section of the unit 26 and the outputs of the comparator 25 are connected to the inputs of the control unit 17. A pulse generator 28 generates pulses in response to the length of the web 6 unrolled during different revolutions of the old roll 5. The output of the web length pulse generator 28 is connected to a web length pulse counter 27 which applies the counted data to the input of the computing and storing unit 26. The control unit 17 is also connected to the counting and storing unit 26 to feed into the latter the information concerning the performed controlling steps and to receive from the computing and storing unit common signals for starting and terminating respective controlling operations. Furthermore, one input of the control circuit 17 is connected to respective angular position impulse generators 21, 22 and 23 and in cooperation with a non-illustrated position feeler of the rotary reel support 1 it applies to the circuit 17 an information about the angular position of the leading adhesive portion of the new web roll 7. In this example, the angular position impulse generator 22 cooperates with the acceleration drive 10 to rotate the new roll 7 into a position in which the leading adhesive end portion of the new web faces the track of the old web 6.

Further controlling steps for the roll exchange take place in dependency on the number of windings remaining on the old roll 5. A measure for the instantaneous number of windings is the counted number of the revolution indicating impulses Z generated in the course of unrolling of the old roll 5. For example, M pulses are generated per each revolution of the old roll 5 and these pulses are continuously counted by the counter 24.

Before the actuation of the control elements for performing the roll exchanging process, the computing and storing unit 26 computes from the information which is received from the control unit 17 control numbers $Z_D$, $Z_B$, $Z_A$ and $Z_T$ corresponding respectively to the number of counting pulses at which the rotary support 1 displaces the new roll 7 into its adhering position, to the acceleration of the new roll 7, to the compression of the old web 6 against the adhesive portion of the new roll, and to the severing of the remainder of the old web 6. These control numbers are stored in the storing section of the unit 26 and, as mentioned before, are applied to one of the inputs of the parallel comparator 25. The comparator 25 compares the amount of pulses corresponding to the actual revolutions of the old roll 5 with the stored control numbers and after coincidence of the actual pulses with the control numbers releases an output signal which actuates via the control unit 17 the assigned control members 8, 10, 13, 16 and solenoid 15.

The computation of the set of control numbers is made from the total number of counting pulses $Z_H$ during which the old roll is unrolled from a starting counting position to the diameter $d_H$ of the central reel or sleeve of the roll. This total number of counting pulses $Z_H$ is computed from the ratio of two intervals $\Delta W$ of the web length counting pulses W to two corresponding intervals $\Delta Z$ of revolution counting pulses Z measured on the old roll 5, from the central reel or sleeve diameter $d_H$, the thickness D of the web and the number of counting pulses M per each revolution of the old roll. The web length counting pulse is generated per each predetermined length U of the unrolled web. The web length counting pulses W are continuously counted similarly as the revolution counting pulses Z in a web length counter 27.

Figure 2:
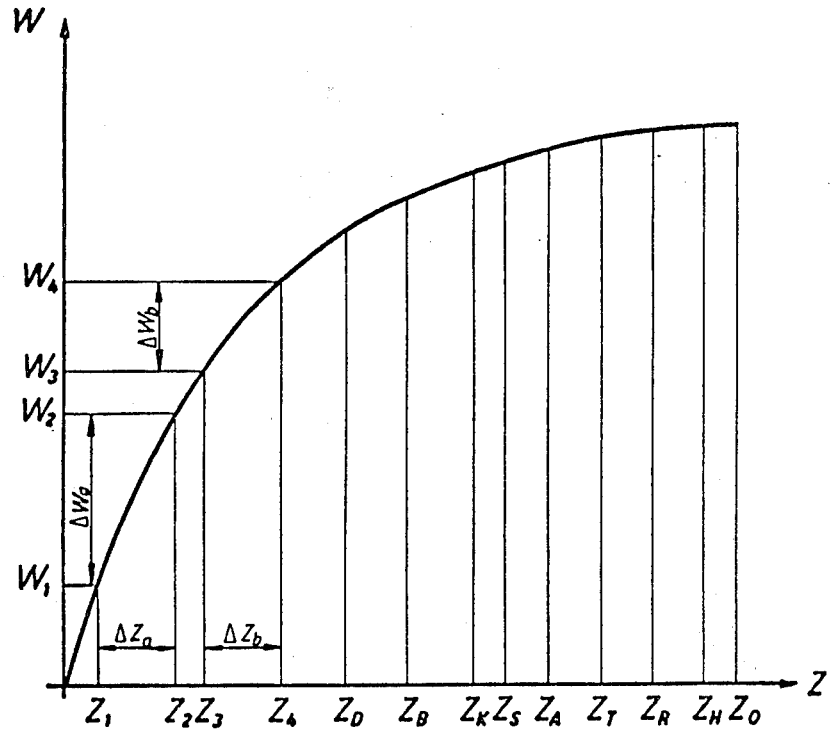
FIG. 2 is a plot diagram of the number of counting pulses corresponding to the number of revolutions of the old roll plotted against the number of pulses corresponding to the withdrawn length of the web of the old roll.

FIG. 2 illustrates graphically the dependency of the web length counting pulses W on the revolution counting pulses Z. For the sake of simplicity it is assumed that $Z_1=0$ and $\Delta Z_a=\Delta Z_b$ and under this condition a theoretical total number of revolution counting pulses $Z_o$ corresponding to the unrolling of the web up to the central point of the roll is $$Z_o = \Delta Z_c \cdot \frac{\Delta W_a}{\Delta W_a - \Delta W_b} + \frac{\Delta Z_a}{2}.$$

whereby $\Delta Z_a=\Delta Z_b=Z_2-Z_1=Z_4-Z_3$ $\Delta Z_c=Z_3-Z_1=Z_4-Z_2$ $\Delta W_a=W_2-W_1$ $\Delta W_b=W_4-W_3.$ The actual total number of counting pulses equals $$Z_H = Z_o - d_H \cdot \frac{M}{2D}.$$

The web thickness D is computed as follows:

$$D = \frac{U \cdot M^2}{2\pi} \cdot \frac{\Delta W_a - \Delta W_b}{\Delta Z_a \cdot \Delta Z_c}$$

From the total number of counting pulses $Z_H$ is computed the control number $Z_R$ at which the roll exchanging process is completed:

$$Z_R=Z_H-N_R \cdot M.$$

The expression $N_R$ denotes the number of residual windings of the web remaining on the central reel of the old roll 5.

The remaining control numbers for releasing the individual steps of the roll exchanging operation are computed from the dependency of the counting pulses on the feeding speed of the web according to the following equation:

$$Z_i = Z_o - \sqrt{(Z_o - Z_v)^2 - \frac{V \cdot T_i \cdot M^2}{\pi \cdot D}}$$

Wherein iE{D,B,A,T}. This equation reveals that the revolution counting unit 24 in the course of the time $T_i$ has continued the counting of revolution pulses from the control number $Z_i$ to the control number $Z_v$. That means that for the time period $T_i$ it is possible to compute or preset the time constants for initiating the individual roll exchange controlling steps. The length of the residual web remaining on the old roll is also computed as a function of time and evaluated together with the time constants of the cutter actuating solenoid 15. The feeding or unrolling speed V of the web 6 is computed from the number of web lengths counting pulses per preset time interval $T_v$ and the length of the web per each web length counting pulse is computed from the equation $$V = \frac{\Delta W_v \cdot U}{T_v}.$$

It is of advantage when the contact points of the brush 11 and of the blade 14 are exactly adjusted with respect to the adhesive leading end portion of the new web 7. For this purpose, control numbers $Z_A$ and $Z_T$ for activating the brush driving motor 13 and the cutter driving solenoid 15 are computed by the computing and storing unit 26 with respect to a control number $Z_S$ which indicates the angular position of the adhesive leading end portion of the new web. The control number $Z_S$ determines upon the coincidence with the actual count of revolution counting pulses at the output of the counter 24 and the coincidence of the first impulse from the angular position indicator 22 and after a predetermined number of rotation counting pulses $Z_K$ indicating the length and the proper position of the adhesive leading end portion of the new web, an actuation impulse for compressing the brush 11 and severing the remainder of the old web after the adhering step is completed.

The control number $Z_K$ is computed from the equation $$Z_K = Z_o - \sqrt{(Z_o - Z_R)^2 - \frac{V \cdot T_K \cdot M^2}{\pi \cdot D}}$$

whereby $T_K$ is a time constant for initiating the adhering or glueing step.

It will be understood that each of the elements described above, or two or more together, may also find a useful application in other types of constructions differing from the types described above.

While the invention has been illustrated and described as embodied in an unrolling device for use in connection with the web fed printing machines, it is not intended to be limited to the details shown, since various modifications and structural changes may be made without departing in any way from the spirit of the present invention. For example, this invention is also applicable for use in connection with cross cutters or with coating machines. Also, a two arm reel support can be used instead of the three arm support. In another modification the unrolling device can be equipped with an accelerating member which is coupled to the center of the new roll instead of engaging its periphery.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of controlling the exchange of rolls of a web-like material having an adhesive leading end portion comprising the steps of counting the number of revolutions of the old roll and counting the number of length units unrolled from the old roll, computing from at least two separate intervals of the counted number of revolutions and corresponding intervals of the counted number of web length units parameters including the diameter of the central supporting reel, the web thickness and the number of counting pulses per one revolution of the old roll, the total number of revolutions needed for unrolling the old roll; computing from the ascertained total number of revolutions and from preset parameters including the length of the adhesive leading end portion of the new roll and the permissible length of the residual trailing end portion of the old web, a set of control numbers for initiating respective steps of the roll exchanging operation; comparing the control numbers with the actual number of revolutions of the old roll to start swinging of the new roll into its adhering position in proximity to the web of the old roll, then accelerating the new roll to a circumferential speed corresponding to the speed of movement of the web of the old roll and holding the latter speed constant, pressing the moving web of the old roll against the adhesive end portion of the new roll and severing the remainder of the web of the old roll.

2. A method as defined in claim 1, wherein the computation of said control numbers is repeated before the start of the roll exchanging operation in response to each change of the speed of movement of the web of the old roll.

3. A method as defined in claim 1, wherein each revolution of the old roll is converted into a predetermined number M of pulses which are continuously converted into counting pulses Z.

4. A method as defined in claim 3, wherein five control numbers $Z_o$, $Z_B$, $Z_K$, $Z_A$ and $Z_D$ for the successive release of the roll exchanging steps are determined from the total number of counting pulses $Z_H$ at which the old roll is unrolled to the diameter $d_H$ of the supporting reel, computed from the magnitude of two intervals $\Delta W_A$ and $\Delta W_B$ of counting pulses W of the uniform length U of the unrolled old web and from the corresponding intervals $Z_A$ and $\Delta Z_V$ of the counting pulses Z of the old roll, from the spacing of the latter intervals, from the diameter $d_H$ of the supporting reel, from the web thickness D and from the predetermined number of pulses M per each revolution of the old roll.

5. A method as defined in claim 4, further including the computation of the speed V of movement of the old web from the number $\Delta W_V$ of the web length pulses counted during a predetermined time interval $T_V$ and the web length U travelled during one web length counting pulse, from the web thickness D and from the magnitude of the two intervals $\Delta W_A$ and $\Delta U_V$ of the web length pulses and from the corresponding intervals $\Delta Z_a$ and $\Delta Z_b$ of the revolutions of the old roll, from the spacing of the latter intervals, and the number of predetermined pulses M for one counting pulse Z for one revolution of the old roll.

6. A device for unrolling rolls of a web-like material comprising means for supporting an old roll of the web being unrolled and a new roll, means for adjusting the circumferential speed of the new roll to the speed of movement of the web of the old roll, means for adhering a portion of the moving web to the leading end portion of the new roll, means for severing the trailing end portion of the moving web, and a control system for controlling the exchange of the new roll for the old one, said system including means for computing prior to the initiation of the roll exchanging operation the total number of revolutions of the old web necessary for the complete unrolling of the web, and means for computing and storing control numbers which when compared with the actual number of revolutions of the old roll release control impulses for initiating and performing the roll exchanging operation.

7. A device as defined in claim 6, wherein said controlling system includes pulse generators coupled to respective rolls, to generate a predetermined number M of pulses during each revolution of the roll, a second pulse generator coupled to the moving web of the old roll to generate a pulse for a predetermined length of displacement of the old web, a revolution counter coupled to the first generator for counting the revolutions of the old web, a web length counter coupled to the second pulse generator to count the withdrawn length of the web, a computing and storing unit for computing from two intervals of the counted web length and from corresponding intervals of the counted revolutions a set of control numbers and for storing said control numbers, a comparator having one input connected to the output of the revolution counter and another input connected to the storing section of said computing and storing unit to compare said control numbers with the actual count of revolutions, a control circuit controlled by said computing and storing unit and being connected to the output of said comparator to release control signals fed successively to respective means for activating the roll exchanging operation.

8. A device as defined in claim 7 further including additional pulse generators coupled to respective central reels on each roll to indicate the angular position of the new roll with respect to its adhesive leading end portion.

* * * * *